US008453795B2

(12) United States Patent
Lee et al.

(10) Patent No.: US 8,453,795 B2
(45) Date of Patent: Jun. 4, 2013

(54) RECONFIGURABLE STEP

(75) Inventors: Melody Lee, Markham (CA); Kevin Xin, Toronto (CA)

(73) Assignee: Merry Products Corporation, Markham, Ontario (CA)

( * ) Notice: Subject to any disclaimer, the term of this patent is extended or adjusted under 35 U.S.C. 154(b) by 106 days.

(21) Appl. No.: 12/838,064

(22) Filed: Jul. 16, 2010

(65) Prior Publication Data

US 2011/0017547 A1 Jan. 27, 2011

Related U.S. Application Data

(60) Provisional application No. 61/227,609, filed on Jul. 22, 2009.

(51) Int. Cl.
*A47C 12/00* (2006.01)

(52) U.S. Cl.
USPC ..... 182/33

(58) Field of Classification Search
USPC .. 182/23, 33.2–33.4, 33; D25/63, 65; 52/183; 108/115, 124; 297/423.39, 423.41, 423.14, 297/175, 16.1, 17, 44
See application file for complete search history.

(56) References Cited

U.S. PATENT DOCUMENTS

| | | | | | |
|---|---|---|---|---|---|
| 393,169 | A | * | 11/1888 | McGowan | 182/33.2 |
| 395,539 | A | * | 1/1889 | Bockenheuser | 182/33.2 |
| 1,046,055 | A | * | 12/1912 | DiOrio | 15/265 |
| 1,280,797 | A | | 10/1918 | Michenfelder | |
| 1,557,342 | A | | 10/1925 | Schlamp | |
| 1,654,386 | A | * | 12/1927 | Seaman | 182/33.4 |
| 1,827,418 | A | * | 10/1931 | Brown | 182/33 |
| 1,896,451 | A | * | 2/1933 | Lofton | 182/33 |
| 2,291,996 | A | * | 8/1942 | Tucker | 182/33.2 |
| 2,658,640 | A | | 11/1953 | Bayles | |
| 2,675,058 | A | * | 4/1954 | Meagher | 182/33 |
| 2,691,405 | A | * | 10/1954 | Hinch | 182/33.2 |
| 3,035,671 | A | * | 5/1962 | Sicherman | 52/183 |
| 3,530,954 | A | | 9/1970 | Schmidt | |
| 3,716,254 | A | * | 2/1973 | Tarvin | 280/166 |
| 4,250,977 | A | * | 2/1981 | Deli | 182/33.6 |
| 4,753,320 | A | * | 6/1988 | Walter | 182/33 |
| 5,094,505 | A | * | 3/1992 | Nichols | 297/118 |
| 5,107,957 | A | * | 4/1992 | Bennett | 182/129 |
| D331,808 | S | | 12/1992 | Paul et al. | |
| 5,357,876 | A | | 10/1994 | Kniefel et al. | |
| D383,261 | S | | 9/1997 | Karsten et al. | |
| 6,267,082 | B1 | | 7/2001 | Naragon et al. | |
| 6,886,660 | B2 | * | 5/2005 | Sapatova | 182/33 |
| 6,964,246 | B2 | | 11/2005 | Wolfington et al. | |
| 7,234,415 | B2 | | 6/2007 | Dietz | |
| 7,493,874 | B2 | | 2/2009 | Simpson et al. | |

(Continued)

*Primary Examiner* — James O Hansen
*Assistant Examiner* — Kristine Florio
(74) *Attorney, Agent, or Firm* — Harness, Dickey & Pierce, P.L.C.

(57) ABSTRACT

A stepping device is provided and includes a first step member having a first riser and a first tread; a second step member having a second riser and a second tread; and a third step member having first, second, and third panels oriented orthogonal to one another. The first step member is fixedly attached to the second step member. The third step member is rotatably attached to the second step member and is rotatable relative to the second step member to configure the stepping device between a two-step configuration and a three-step configuration. In the two-step configuration, The first panel is generally planar with the second tread.

14 Claims, 5 Drawing Sheets

U.S. PATENT DOCUMENTS

D653,043 S * 1/2012 Rumley ..... D6/338
8,157,053 B1 * 4/2012 Lameiro ..... 182/36
2006/0272083 A1 * 12/2006 Kruger ..... 4/496
2008/0302312 A1 12/2008 Steffey et al.

* cited by examiner

RECONFIGURABLE STEP

CROSS-REFERENCE TO RELATED APPLICATIONS

This application claims the benefit of U.S. Provisional Application No. 61/227,609, filed on Jul. 22, 2009, the disclosure of which is incorporated herein by reference.

FIELD

The present disclosure relates generally to a stepping device, and more particularly, to a stepping device reconfigurable between various height arrangements.

BACKGROUND

This section provides background information related to the present disclosure which is not necessarily prior art.

Stepping devices are used for a variety of purposes inside and outside of the home. The stepping device provides extended height to a user to reach otherwise unattainable items. For example, step stools are often used to enable a child to reach a lavatory or a sink, foldable ladders are often used to reach high shelves, and pet steps are used to enable an animal to reach typical household furniture (e.g. couches and beds).

As most stepping devices are of a fixed height, a user must often purchase multiple devices to support different height requirements. Alternatively, a user may purchase a height adjustable stepping device. Among other limitations, the known height adjustable stepping devices, however, are heavy, expensive, and not easily mobile from room-to-room.

SUMMARY

This section provides a general summary of the disclosure, and is not a comprehensive disclosure of its full scope or all of its features.

A stepping device is provided and includes a first step member, a second step member, and a third step member. The first step member has a first riser and a first tread. The second step member has a second riser and a second tread. The third step member has first, second, and third panels oriented orthogonal to one another. The first step member is fixedly attached to the second step member. The third step member is rotatably attached to the second step member and is rotatable relative to the second step member to configure the stepping device between a two-step configuration and a three-step configuration. In the two-step configuration, the first panel is generally planar with the second tread.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings. It will be understood that the views are drawn to scale.

DETAILED DESCRIPTION OF VARIOUS ASPECTS

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
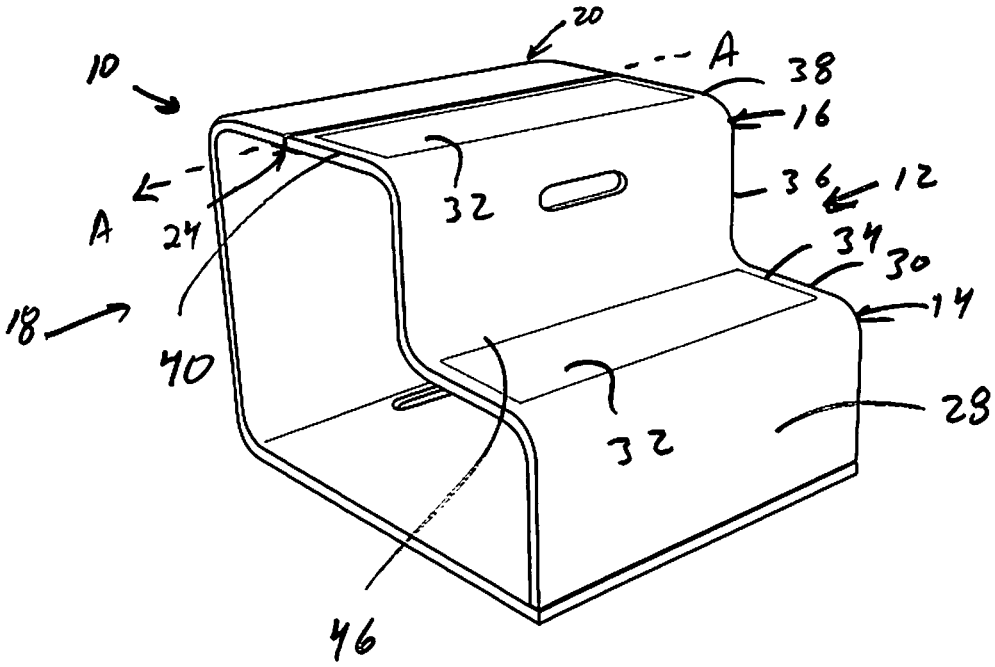
FIG. 1 is a perspective view of a stepping device in a two-step arrangement in accordance with the teachings of the present disclosure.
Figure 2:
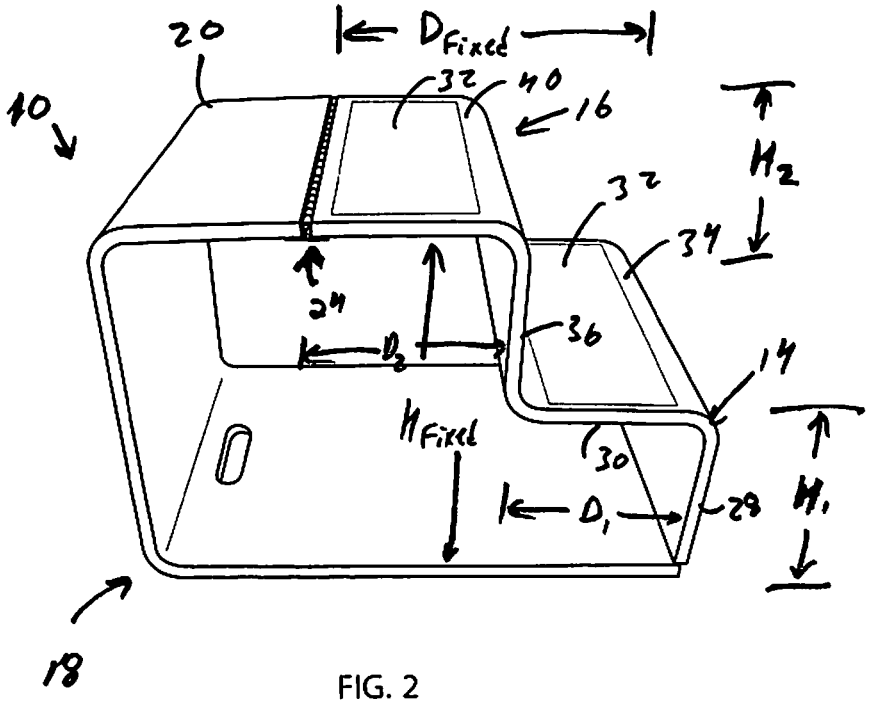
FIG. 2 is a side view of the stepping device of FIG. 1, shown in the two-step arrangement.
Figure 3:
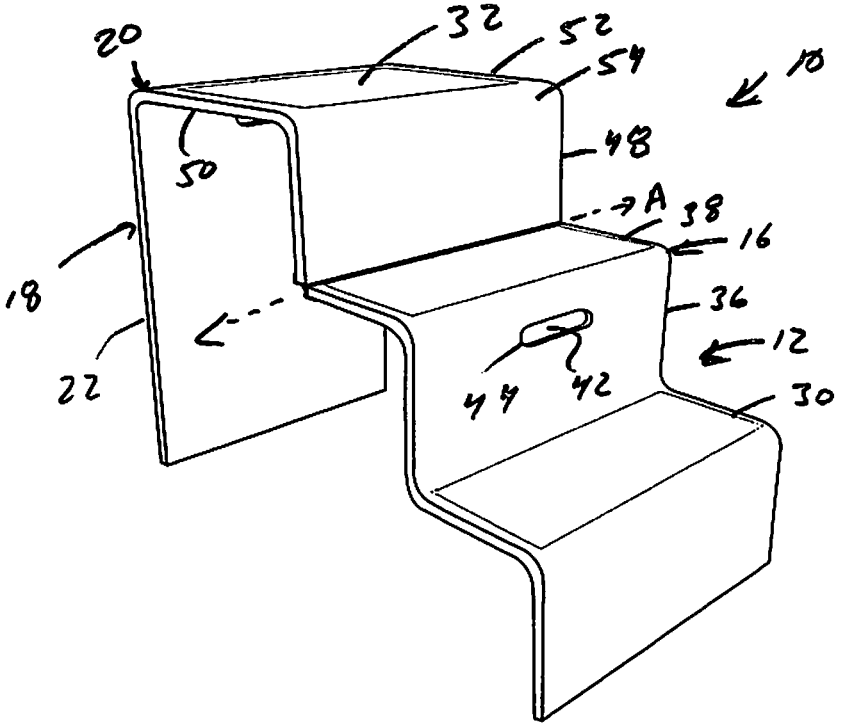
FIG. 3 is a perspective view of the stepping device of FIG. 1 arranged in an alternative three-step arrangement.

With initial reference to FIGS. 1-5 of the drawings, a stepping device in accordance with the present teachings is illustrated and generally identified at reference number 10. As will be described more fully below, the stepping device 10 may be oriented in various configurations to achieve alternative height arrangements. In the embodiment described, the stepping device 10 is configurable between a two-step arrangement (FIG. 1) and a three-step arrangement (FIG. 3). The principles of the present invention, however, might similarly be adopted for stepping devices having more or fewer number of steps. Additionally, although the following description relates generally to an apparatus for use in assisting a pet with climbing up and down from defined heights, it should be understood that the apparatus as described and claimed herein could be used in any manner where it is desired to assist with elevation of a user. Therefore, the following discussions are not intended to limit the scope of the present teachings and claims herein.

Figure 4:
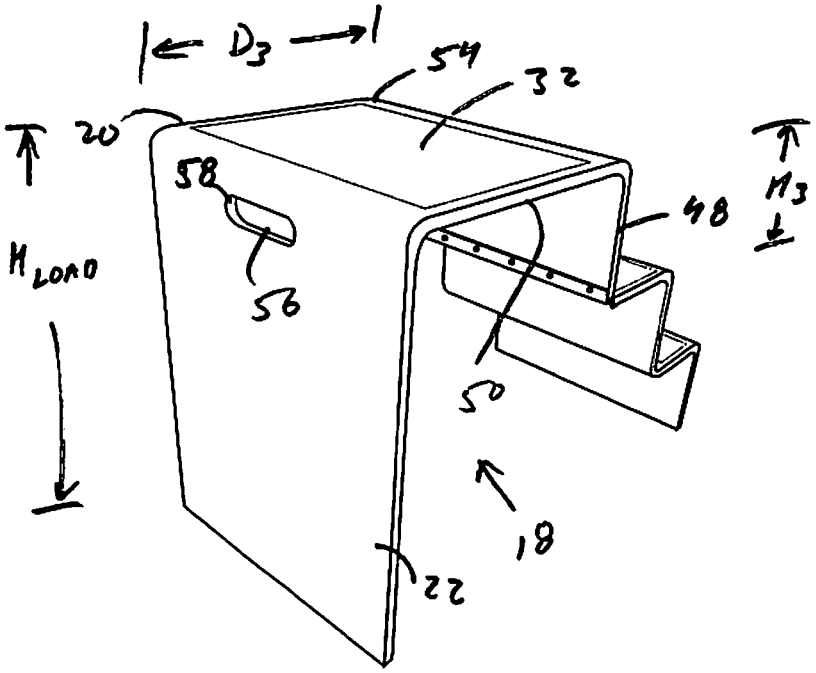
FIG. 4 is another perspective view of the stepping device of FIG. 3 showing a rear portion of the alternative three-step arrangement.

The stepping device 10 includes a fixed section 12 having a first step member 14 and a second step member 16; a rotatable section 18 having a third step member 20 and a load panel 22; and a hinge device 24 interconnecting the fixed and rotatable sections 12, 18. The third step member 20 is rotatable relative to the second step member 16 through the hinge device 24 and about a pivot axis, A. As will be appreciated more fully below, such rotation reconfigures the stepping device 10 between the two-step configuration (FIGS. 1 and 2) and the three-step configuration (FIGS. 3 and 4).

Referring now to FIGS. 1 and 2, the first step member 14 includes a riser 28 and a tread 30. The riser 28 may be affixed to the tread 30 in any manner known in the art so as to define an orthogonal relationship between the riser 28 and the tread 30. The tread 30 may further include a tread covering 32 extending over at least a portion of a top surface 34 of the tread 30. The tread covering 32 may be a non-skid material that is fixedly attached to the tread 30 so as to prevent slipping by the user when the stepping device 10 is in use. The tread covering 32 may be carpeting, rubber, a carpeting/rubber blend, or any other non-skid material known in the art.

In certain embodiments, the tread covering 32 may be removably attached to the tread 30 so as to allow the covering 32 to be easily removed for cleaning purposes, such as through a Velcro® attachment. In this way, the tread covering 32 may be easily replaceable and may be changed to accommodate different environments.

Similarly to the first step member 14, the second step member 16 includes a riser 36 and a tread 38. The riser 36 may be affixed to the tread 38 in any manner known in the art so as to define an orthogonal relationship between the riser 36 and the tread 38. The tread 38 also includes the tread covering 32 extending over at least a portion of a top surface 40 of the tread 38.

The riser 36 of the second step member 16 may also include an aperture 42. The aperture 42 may be generally ovular and may be sized so as to accept a hand. The aperture 42 defines a handle portion 44 for comfortably receiving the hand during maneuvers, such as when transporting or reconfiguring the stepping device 10.

The first step member 14 may be fixedly attached to the second step member 16 at seam 46 to define an increasing height arrangement for the stepping device 10. Alternatively, the first step member 14 may be integrally formed with the second step member 16. The first step member 14 and the second step member 16 are depicted as being formed from a single sheet of material as a unitary body or fixed section 12 (e.g., formed plastic). It should be understood, however, that the first and second step members 14, 16 may be assembled to form the unitary body or fixed section 12 (e.g., wooden panels). In such an arrangement, the first and second step members 14, 16 may be joined in any manner known in the art so as to create the orthogonal relationship between the consecutive step members 14, 16.

Referring now to FIGS. 3 and 4, the third step member 20 of the rotatable section 18 includes a riser panel 48 and a tread panel 50. The riser panel 48 and the tread panel 50 are fixedly attached to each other in an orthogonal relationship. When in the three-step configuration as depicted, the tread panel 50 acts as a third tread 52, behaving similarly to the treads 30, 38 of the fixed section 12. Accordingly, the third tread 52 may include the tread covering 32 extending over at least a portion of a top surface 54 of the third tread 52.

The tread panel 50 may also be fixedly attached and orthogonal with the load panel 22. As can be seen, the load panel 22 is also generally parallel to the riser panel 48. The load panel 22 may further include an aperture 56, which may dimensionally correspond to the aperture 42 in the riser 36 of the second step member 16. Accordingly, the aperture 56 may define a second handle portion 58 cooperating with the handle portion 44 for comfortably receiving the user's other hand during maneuvers, such as transporting or reconfiguring the stepping device 10.

Figure 5:
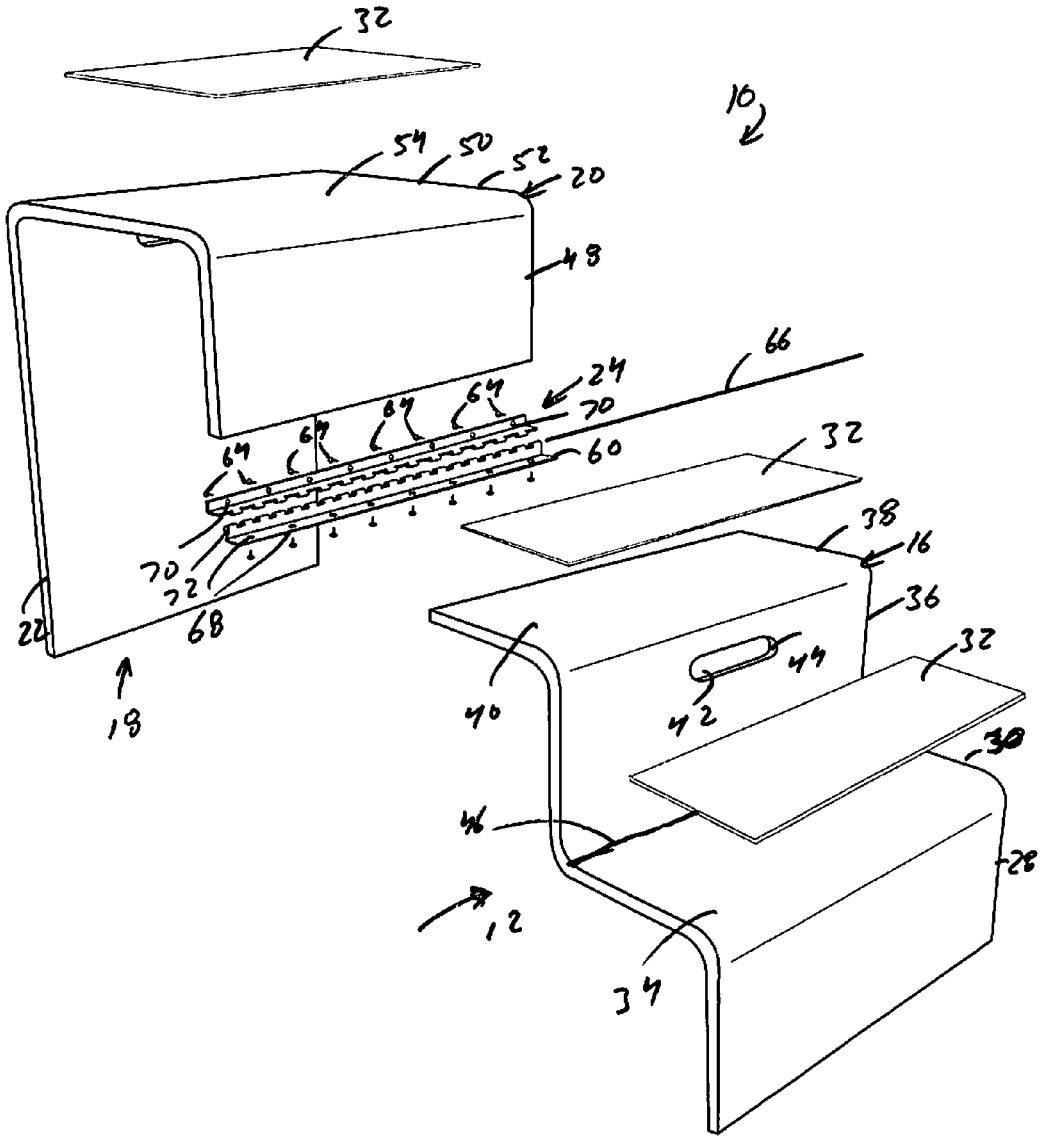
FIG. 5 is an exploded view of the alternatively arranged stepping device of FIG. 3.

Referring now to FIG. 5, the third step member 20 may be rotatably attached to the second step member 16 through the hinge device 24. The hinge device 24 includes a first stop hinge track 60, a second stop hinge track 62, a plurality of fasteners 64, and an attachment pin 66. The first stop hinge track 60 includes a plurality of apertures 68 for receiving the plurality of fasteners 64, which in turn, fasten the first stop hinge track 60 to the tread 38 of the second step member 16. Likewise, the second stop hinge track 62 includes a plurality of apertures 70 through which the plurality of fasteners 64 extend for fastening the second stop hinge track 62 to the riser panel 48 of the third step member 20. The attachment pin 66 extends through alternating loops 72 integrally formed in the first and second stop hinge tracks 60, 62 for joining the first and second stop hinge tracks 60, 62.

In the present embodiment, the third step member 20 is operable to rotate relative to the second step member 16 through an angle no greater than 90 degrees (e.g. a right angle) due to the right-angled shape of the first and second stop hinge tracks 60, 62. In this way, the hinge device 24 may not only attach the fixed and rotatable sections 12, 18, but may also prevent the fixed and rotatable sections 12, 18 from extending past a predetermined angle. While the hinge device 24 is described as a stop hinge, other hinges known in the art may be used to achieve the required angular relationship, for example, a butt hinge or a box hinge.

With respect to the fixed section 12 (FIG. 2), the riser 28 of the first step member 14 has a height, $H_1$, corresponding to the required step height for the first step member 14. The riser 36 of the second step member 16 has a height, $H_2$, corresponding to the required step height for the second step member 16. A summation of the risers 28, 36 provides an overall fixed section height, $H_{FIXED}$. Likewise, the tread 30 of the first step member 14 has a depth, $D_1$, corresponding to the required step depth for the first step member 14. The tread 38 of the second step member 16 has a depth, $D_2$, corresponding to the required step depth for the second step member 16. A summation of the treads 30, 38 provides an overall fixed section depth, $D_{FIXED}$. $H_1$, $H_2$, $D_1$, and $D_2$ are shown as being equal in dimension (e.g. about 6.5 inches), however, it should be understood that alternate configurations are contemplated.

With respect to the rotatable section 18 (FIG. 4), the riser panel 40 has a height, $H_3$, corresponding to the required step height for the third step member 20 (e.g. about 6.5 inches). In the present embodiment, the riser panel height, $H_3$, is depicted as being equal to the step member heights $H_1$, $H_2$ for continuity; however, the riser panel height, $H_3$, need not be equal to the step member heights $H_1$, $H_2$.

Likewise, the tread panel 42 has a depth, $D_3$, corresponding to the required step depth for the third step member 20 (e.g. about 13 inches). The depth $D_3$ of the tread panel 42 is equal to the fixed section height, $H_{FIXED}$ (e.g. $D_3=H_1+H_2$).

The load panel 22 has a height, $H_{LOAD}$, equal to the sum of the fixed section depth, $D_{FIXED}$, and the riser panel height, $H_3$ (e.g. $H_{LOAD}=D_1+D_2+H_3$). As can be seen from the various figures, the load panel height, $H_{LOAD}$, is also equal to the sum of the fixed section height, $H_{FIXED}$, and the riser panel height, $H_3$ (e.g. $H_{LOAD}=H_1+H_2+H_3$). As the depth $D_3$ of the tread panel 42 is equal to the fixed section height, $H_{FIXED}$ (e.g. $D_3=H_1+H_2$), the load panel height, $H_{LOAD}$, is also equal to the sum of the depth $D_3$ of the tread panel 42 and the riser panel height, $H_3$ (e.g. $H_{LOAD}=H_1+H_2+D_3$).

In use in the two-step configuration as shown in FIGS. 1 and 2, the riser panel 48 is generally planar with the tread 38 of the second step member 16. This arrangement allows the stepping device 10 to be in a contracted position having a relatively small footprint and a low height (e.g. about 13 inches). In the two-step configuration, the tread panel 50 acts as a rear load support protecting against an otherwise cantilevered design. The load panel 22 is located in a horizontal position in contact with the flooring.

After rotation of the rotatable section 18 around the pivot axis, A, the stepping device 10 achieves the expanded position or three-step configuration with the riser panel 48 orthogonal to the tread 38 of the second step member 16 as shown in FIGS. 3 and 4. The expanded position has a larger footprint, but also achieves a higher height (e.g. about 19.5 inches). In the three-step configuration, the orientation of the load panel 22 is generally orthogonal to the orientation of the load panel 22 in the two-step configuration. In this arrangement, the load panel 22 acts as the rear load support for the stepping device 10.

Accordingly, pets of any size may use the stepping device 10 to reach an article of furniture, such as a sofa, a chair, or a couch. The stepping device 10 may also be used as a pet window seat or a device to reach high pens in a pet care facility. This is especially helpful with large or overweight pets having medical issues, such as hip dysplasia, arthritis, or other injury. Additionally, the lightweight panel form and the dual handle design 44, 58 allows the stepping device 10 to be easily moved from room to room.

Figure 6:
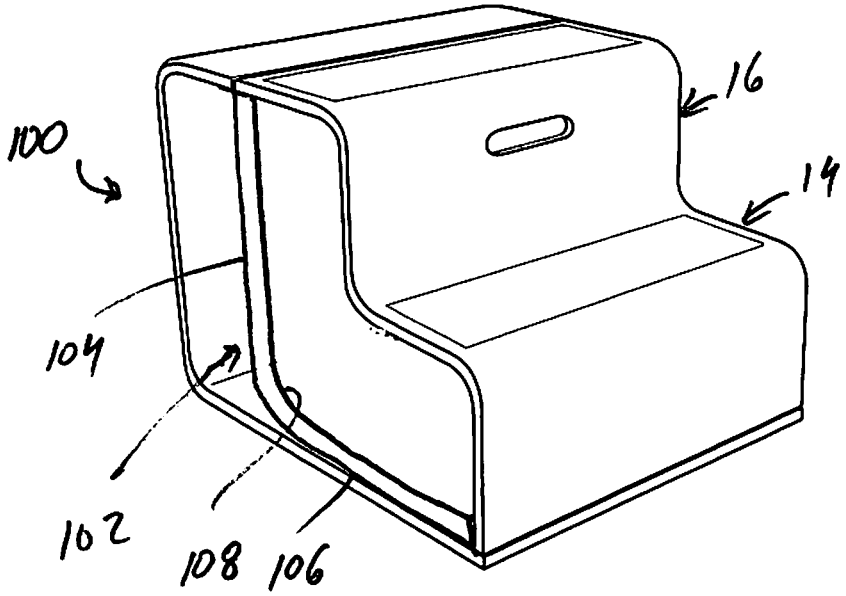
FIG. 6 is a perspective view of another stepping device in a two-step arrangement in accordance with the present teachings.
Figure 7:
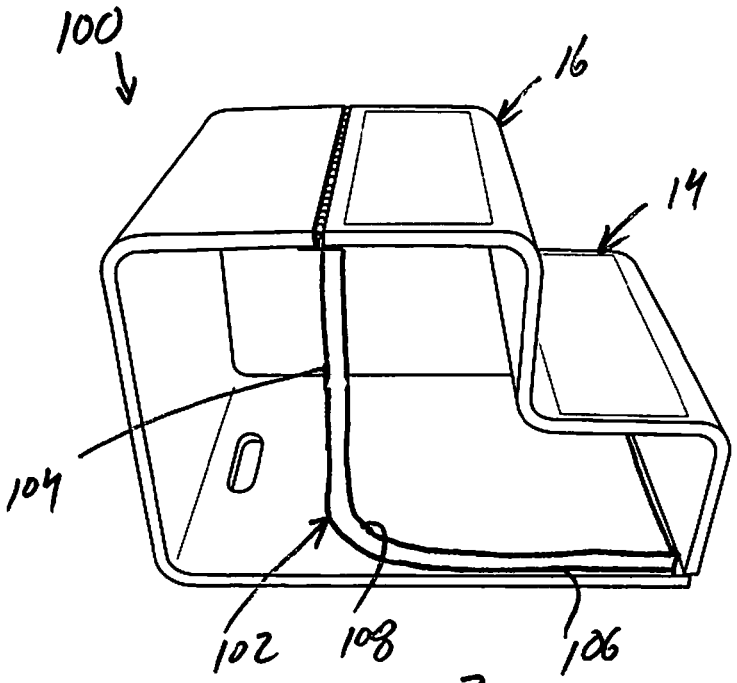
FIG. 7 is a side view of the stepping device of FIG. 6
Figure 8:
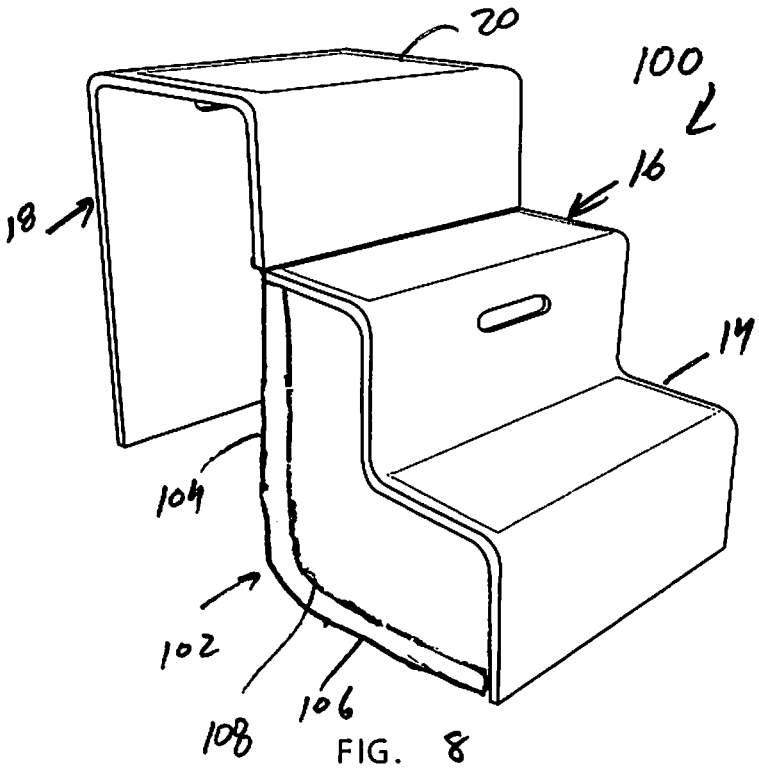
FIG. 8 is a perspective view of the stepping device of FIG. 6 arranged in an alternative three-step configuration.

Turning to FIGS. 6 through 8, another stepping device in accordance with the present teachings is illustrated and generally identified at reference character 100. Given the similarities between the stepping device 10 and the stepping device 100, like reference characters have been used to identify similar components. It will be understood that the stepping device 100 is identical to the stepping device 10 to the extent not otherwise described herein.

The stepping device 100 differs from the stepping device 10 in that it incorporates an additional support member 102. Support member 102 includes a first portion or generally vertical portion 104 and a second portion or generally horizontal portion 106. The first portion 104 and the second portion 106 may be integrally formed of a single sheet of common material. As illustrated, the first and second portions are interconnected to one another at a curved segment 108. Alternatively, the first and second portions 104 and 106 can be formed of distinct sheets that are suitably joined in an manner well known in the art.

The first portion 104 has an upper end that terminates proximate to and abuts an underside of the second step member 16. The second portion 106 terminates proximate to and abuts the riser 28 of the first step member 14. The support member 102 may be suitable secured to the first and second step members 14 and 16 in any manner well known in the art.

In the two-step configuration (as shown in FIGS. 6 and 7, for example) the rotatable section 18 wraps around the support member 102. The Support member 102 provides additional support at the second step 16. Load from the second step may be transferred to the rotatable section 18 and from the rotatable section 18 to the ground. In the three step configuration (as shown in FIG. 8, for example), the support member 102 similarly functions but the second portion 104 of the support member 102 is directly supported by the ground or floor.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A stepping device comprising:

a first step member including a first riser and a first tread;

a second step member including a second riser and a second tread, the first step member fixedly attached to the second step member; and a third step member including first, second, and third panels, the first and third panels oriented orthogonal to the second panel, the third step member rotatably attached to the second step member, wherein the third step member is rotatable relative to the second step member to configure the stepping device between a two-step configuration and a three-step configuration, the first panel being generally planar with the second tread in the two-step configuration;

wherein the orientation of the third panel of the third step member in the three-step configuration is generally orthogonal to the orientation of the third panel in the two-step configuration, and wherein the third panel of the third step member has a height equal to a collective height of the first and second risers and the first panel of the third step member; and, wherein the second panel of the third step member is oriented vertically and has a height equal to a collective height of the first and second risers when in the two-step configuration, and wherein the second panel of the third step member is oriented horizontally and defines a third tread when in the three-step configuration.

2. The stepping device of claim 1, wherein the third step member is rotatable relative to the second step member about a pivot axis.

3. The stepping device of claim 2, wherein the third step member is operable to rotate relative to the second step member through an angle no greater than 90 degrees.

4. The stepping device of claim 1, wherein the third step member is rotatably attached to the second step member with a hinge for preventing the panels from extending past a predetermined angle.

5. The stepping device of claim 4, wherein the predetermined angle is generally a right angle.

6. The stepping device of claim 4, wherein the hinge is one of a stop hinge, a butt hinge, and a box hinge.

7. The stepping device of claim 1, wherein at least one of the second riser and the third panel defines a handle portion.

8. The stepping device of claim 7, wherein the handle portion defines at least one aperture in the stepping device.

9. A portable step structure, comprising:

a first section defining at least one step having a riser and a tread, the riser defining a step height and a summation of all risers defining a first section height; and a second section interconnected to the first section and rotatable between a contracted position and an expanded position, the second section further comprising:

a first panel rotatably fastened to an upper-most tread of the first section and having a first panel height equal to the step height, wherein the first panel is planar with a top surface of the first section in the contracted position and orthogonal to the top surface of the first section in the expanded position;

a second panel orthogonal to the first panel, the second panel having a second panel height equal to the first section height; and a third panel orthogonal with the second panel and parallel to the first panel, the third panel having a third panel height equal to a summation of the first and second panel heights.

10. The portable step structure of claim 9, wherein the second panel acts as a rear load support when the second section is in the contracted position.

11. The portable step structure of claim 9, wherein the third panel acts as a rear load support when the second section is in the expanded position.

12. The portable step structure of claim 9, further comprising a covering extending over at least a portion of the at least one tread of the first section and the second panel of the second section.

13. The portable step structure of claim 12, wherein the covering is a non-skid material.

14. The portable step structure of claim 9, wherein the first section and the second section define a pair of handles.

* * * * *